United States Patent [19]

Malkin et al.

[11] 3,992,278

[45] Nov. 16, 1976

[54] ELECTROLYSIS CATHODES HAVING A MELT-SPRAYED COBALT/ZIRCONIUM DIOXIDE COATING

[75] Inventors: Irving Malkin, University Heights; James R. Brannan, Painesville, both of Ohio

[73] Assignee: Diamond Shamrock Corporation, Cleveland, Ohio

[22] Filed: Sept. 15, 1975

[21] Appl. No.: 613,320

[52] U.S. Cl. ..... 204/242; 204/290 R; 204/291; 204/292; 429/44

[51] Int. Cl.[2] ..... C25B 11/04

[58] Field of Search ..... 136/120 FC; 204/242, 204/290 R, 290 F, 291, 292

[56] References Cited

UNITED STATES PATENTS

| | | | |
|---|---|---|---|
| 1,442,238 | 1/1923 | Smith | 204/292 X |
| 3,492,720 | 2/1970 | Guthke et al. | 136/120 FC |
| 3,775,284 | 11/1973 | Bennett et al. | 204/290 F |
| 3,917,525 | 11/1975 | Bouy et al. | 204/290 F |
| 3,943,048 | 3/1976 | Fisher et al. | 204/290 R |

FOREIGN PATENTS OR APPLICATIONS

| | | | |
|---|---|---|---|
| 1,801,402 | 5/1970 | Germany | 204/290 F |
| 1,147,442 | 4/1969 | United Kingdom | 204/290 F |

*Primary Examiner*—F. Edmundson
*Attorney, Agent, or Firm*—Theodore J. Dettling

[57] ABSTRACT

A cathode adapted for the electrolysis of water or an aqueous alkali metal halide salt solutions because it gives prolonged lowering of hydrogen overvoltage is provided by an electrically conductive substrate bearing on its surface a coating of a melt-sprayed admixture of particulate cobalt and particulate zirconia.

9 Claims, No Drawings

ELECTROLYSIS CATHODES HAVING A MELT-SPRAYED COBALT/ZIRCONIUM DIOXIDE COATING

BACKGROUND OF THE INVENTION

This invention is directed to cathodes useful in the electrolysis of water containing an alkali metal hydroxide electrolyte or the elctrolysis of aqueous alkali metal halides. More particularly it is directed to cathodes having a coating of cobalt and zirconium dioxide applied by melt spraying that exhibits in those electrolytic processes reduced hydrogen overvoltage and good durability and life span.

In the electrolysis of water or aqueous alkali metal halides in electrolytic cells having a diaphragm or membrane separator, the working voltage required comprises, in the main, the decomposition voltage of the particular salt being electrolyzed, the voltages required to overcome the ohmic resistances of the electrolyte and the cell electrical connections, and the potentials, known as "overvoltages", required to overcome the passage of current at the surfaces of the cathode and anode. Such overvoltage is related to factors as the nature of the ions being charged or discharged, the current per unit area of electrode surface (current density), the material of which the electrode is made, the state of the electrode surface (e.g. whether smooth or rough), temperature, and the presence of impurities in either the electrode or electrolyte. While various theories have been advanced to explain overvoltage, at the present time knowledge of the phenomenon is almost wholly empirical: it being observed that a characteristic overvoltage exists for every particular combination of discharging (or charging) ion, electrode, electrolyte, current density, and so forth.

Because of the multi-million-ton quantity of chloroalkalies and water electrolyzed each year, even a reduction of as little as 0.05 volts in working voltage translates to meaningful economic savings, especially with today's constantly increasing power costs. Consequently, the industry has sought means to reduce this voltage requirement. One means that has received attention is the provision of cathodes that have reduced hydrogen overvoltage: as, for example, cathodes made of or coated with sintered nickel or steel powder, or cathodes having particular metal- or metal alloy-coated surfaces. See, for example, U.S. Pat. Nos. 3,282,808, 3,291,714 and 3,350,294. However, such cathodes have not been adopted, it seems, to any significant degree, and steel or iron cathodes still predominate. While the reasons for such nonuse are not clear, it may be that the costs of some, i.e. cost of producing and life span, versus realizable power savings are unattractive. Another reason may be the inability of others to be readily fabricated. For example, sintered metal coatings are difficult to apply uniformly to irregular shaped cathode substrates such as expanded or woven steel mesh.

SUMMARY OF THE INVENTION

Accordingly, it is an object of the present invention to provide cathodes particularly well suited for use in electrolyzing alkali metal halide salts in cells having a diaphragm or membrane separator, or for use in electrolyzing water, which cathodes have reduced hydrogen overvoltage, good life span, and the ability to be produced from a variety of cathode substrates into desired configurations.

A further object is the provision of bipolar electrodes for water electrolysis having, in addition to the aforedescribed cathode properties, excellent anode properties: particularly, low oxygen overvoltage and a long life span.

These and other objects and advantages, which will be apparent from the following description, are provided, it has been discovered, by cathodes comprising an electrically conductive substrate bearing on at least part of its surface a coating consisting essentially of a melt-sprayed admixture of particulate cobalt and particulate zirconia (zirconium dioxide). Such cathodes have been observed, when used in diaphragm cells electrolyzing aqueous sodium chloride, to reduce hydrogen overvoltage 0.05 to 0.08 volts, depending upon the cathode substrate and current density, and to have prolonged service service life (i.e. running time during which the hydrogen overvoltage is less than that of the cathode substrate). Further, when such cathodes bear on both sides the foraminous cobalt zirconia coating, they may be used as bipolar electrodes in water electrolysis (using an alkali metal hydroxide electrolyte) to advantage because of their low anodic and cathodic overvoltages and good durability.

DESCRIPTION OF THE PREFERRED EMBODIMENTS

The cathode substrate may be any electrically conductive material having the needed mechanical properties and chemical resistance to the catholyte solution generated by the electrolysis of the particular alkali metal halide salt with which it is to be used. Illustrative of materials that may be used are iron, mild steel, stainless steel, titanium, nickel, and the like. Normally the cathode substrate will be foraminous (metal screen, expanded metal mesh, perforated metal, and the like) to facilitate the generation, flow and removal of hydrogen gas formed during electrolysis at the cathode surface. Because of its low cost coupled with good strength and fabricating properties, mild steel is typically used as the cathode substrate, generally in the form of wire screen or perforated sheet. When the invention cathodes are to be used as a bipolar electrode in water electrolysis, solid gas-impermeable cathode substrates will be used.

Prior to being coated, the surfaces of the cathode substrate to be melt-sprayed are cleaned to remove any contaminants that could diminish adhesion of the coating to the cathode substrate by means such as vapor degreasing, chemical etching, sand or grit blasting, and the like, or combination of such means. Good adhesion and low hydrogen overvoltage using steel substrates has been obtained with grit or sand blasting and is generally used.

All or only part of the cathode surface may be coated depending upon the type of electrolytic cell in which the cathode is to be employed. For example, when the cathode is employed in halo-alkali cells wherein a diaphragm is deposited directly upon the side of the cathode facing the anode, then only the nonfacing side will normally be electrolytically active and, hence, need be coated. Conversely, when the cathode is used in halo-alkali cells having a diaphragm or membrane spaced apart from the cathode, both sides of the cathode may be coated. For water electrolysis, when used as a cathode both sides are normally coated, and when used as a bipolar electrode both sides will be coated. The coating may be applied either before or after formation of the desired cathode configuration depending upon the accessability of the cathode surfaces to be coated to the metal spraying equipment and procedures.

The particulate cobalt is, preferably, essentially the neat metal (i.e., about 95% plus cobalt containing normally occuring impurities). Particulate cobalt alloys containing sufficient cobalt to give lowered hydrogen overvoltage, however, may also be used, as, for example, those containing a major proportion of cobalt alloyed with metals such as iron, nickel and the like. Generally, though, particulate cobalt alloys are more costly and not as effective in lowering hydrogen overvoltage as the straight cobalt metal and, hence, normally are used only as a partial replacement for the particulate cobalt metal. With respect to particle size, particulate cobalt metal having particles within the range of about 10 to about 62 microns (produced by screening) has been used. Particulate cobalt metal, alloy, or mixtures of the two having smaller and/or larger particle sizes should also be satisfactory, as can be readily determined. In the description and claims, the expression "particulate cobalt", hence, is used to describe powders of cobalt metal, cobalt alloys or mixtures thereof providing cathode coatings having lowered hydrogen overvoltage.

The particulate zirconia employed had a typical particle size range of 30 to 75 microns (produced by screening) and the following typical composition: zirconium dioxide 93%, calcium oxide 5%, silicon dioxide 0.4%, aluminum oxide 0.5%, and other oxides 1.1%. Particulate zirconia having different compositions and particle sizes should be equally suitable as can be easily determined, and the expression "particulate zirconia" is employed herein and in the claims to describe such materials.

In the coatings of the invention cathodes, the weight ratio of cobalt to zirconia is such that the particulate cobalt constitutes about 40–90%, 60–80% appearing to be optimum, and particulate zirconia about 60–10% of the combined weight of the cobalt and zirconia powders present in the coating. Outside these ranges, hydrogen overvoltage rises to unacceptable levels and/or durability of the coating is lessened, thus diminishing the effective life span of the cathode.

One or more diluent materials, such as particulate iron, nickel, aluminum oxide, titanium dioxide and the like, may be admixed and melt sprayed with the admixture of particulate cobalt and particulate zirconia and generally will be used only in minor quantities (i.e., constitute less than 50% by weight of the total coating components). Generally, no advantage accrues from diluting the invention coating with other materials, and, if used, the composition, quantity and particle size of such diluent materials should be selected so as not to adversely affect the hydrogen overvoltage.

Significant lowering of hydrogen overvoltage is obtained when as little as 3–4 mils of the invention coating is applied to the cathode substrate. However, for good durability and life span, a coating thickness of about 5 mils or more is typically used. Usually, the invention coating thickness will not exceed about 15 mils because of increased costs with no apparent attendant advantage. For maximum uniformity, coatings are best produced by multiple spray pass applications with each pass depositing typically about a 1–3 mil coating.

The invention cathode coating is applied by melt spraying the admixture of particulate cobalt and particulate zirconia with an essentially nonoxidizing melting and spraying gas stream, using spraying parameters that deposit the particulate coating constituents upon the cathode substrate substantially in melted form.

Such melt spraying is readily and efficaciously achieved by means such as flame spraying or by plasma spraying. In flame spraying the particulate coating constituents are melted and sprayed in a stream of a burning flame of a combustible organic gas, usually acetylene, and an oxidizing gas, usually oxygen, employed in a ratio that gives a nonoxidizing flame (i.e., the quantity of oxidizing gas is stoichiometrically less than that required for complete oxidation of the combustible gas). In plasma spraying, the particulate coating constituents are melted and sprayed in a plasma stream generated by heating with an electric arc to high temperatures an inert gas, such as argon or nitrogen, optionally containing a minor amount of hydrogen.

The spraying parameters, such as the volume and temperature of the flame or plasma spraying stream, the spraying distance, the feed rate of particulate coating constituents and the like, are chosen so that the particulate components of the invention coating are melted by and in the spray stream and deposited on the cathode substrate while still substantially in melted form so as to provide an essentially continuous coating (i.e. one in which the sprayed particles are not discernible) having a foraminous structure. Typically, spray parameters like those used in the examples give satisfactory coatings. In this connection, as illustrated in Examples 1, 2, 4 and 6, better results appear to be obtained by cooling the cathode substrate during the spraying operation to maintain it near ambient temperature.

The coated cathodes of the present invention are, as previously described, particularily suitable for electrolytic cells that have either a diaphragm or membrane separator and are used to electrolyze alkali metal halide aqueous salt solutions to the corresponding alkali metal hydroxide and halogen according to conventional procedures known to the art. While useful for any alkali metal halide, as a practical matter, they will normally most often be employed in the electrolysis of sodium or potassium chloride. Also the invention coated cathodes are well adapted for use as the cathode and/or anode in unipolar water electrolyzers or as bipolar electrodes in bipolar water electrolyzers when such devices employ an alkali metal hydroxide as electrolyte, because of their decreased hydrogen overvoltage and/or low oxygen overvoltage for prolonged periods of service. Such water electrolyzers and processes are, in other respects, conventional and known to the art. See, for example, "Water Electrolysis", 11561160, *Encyclopedia of Electrochemistry*.

EXAMPLES 1–6

Test specimens (1 × 3 inches) of steel wire screening (No. 6 mesh) were grit-blasted and melt sprayed on both sides with the coatings shown in the Table. Melt spraying was done either by flame or plasma spraying as indicated. Four spray passes were used per side to deposit coatings having average thicknesses within the range of 5–10 mils.

Flame spraying was done with a Metco 5P spray gun equipped with a P7-G nozzle using the following average spraying parameters:

Acetylene 33 ft.$^3$/hr. 13 psi
Oxygen: 60 ft.$^3$/hr. 20 psi
Coating feed rate: About 95 g/minute
Spray distance 5–7 inches Plasma spraying was done with a Metco 3MB spray gun equipped with a G nozzle and a No. 2 powder port using the following average spraying parameters:

Nitrogen: 75 ft.$^3$/hr. 50 psi
Hydrogen: 15 ft.$^3$/hr. 50 psi
Coating feed rate: About 80 g/minute
Arc voltage and current: 74–30 volts and 500 amps
Spraying distance: 2–2.5 inches Cathode potential was determined by immersing an 1 × 1 inch area of the coated cathode test specimen into 90° C aqueous NaOH (100 gpl) with one of the coated sides facing an immersed dimensionally stable anode (1 square inch immersed area), and determining, with a saturated calomel electrode through a Luggin capillary, the potential at the center of the coated cathode surface required to produce a current of 1, 2, 3 and 4 amperes between the cathode and the anode. The potential of an uncoated control of the No. 6 mesh screen which had been sand blasted was similarily determined.

The hydrogen overvoltage decrease shown in the Table and referred to in the description is simply the difference at any given current density between the potential of the uncoated cathode and the potential of the coated cathode, and generally will be at least about 0.05 volts at a cathode current density of 1 ASI when the invention coating (5 mils or more thickness) is applied to a No. 6 mesh steel wire screen cathode substrate.

As can be seen from the data in the Table, plasma and flame spraying appear to be essentially equivalent, cathode coatings containing 70% cobalt give lower potentials than those containing 40% cobalt, and the coated cathodes exhibit lower hydrogen overvoltage when the cathode substrate is maintained near ambient temperatures during melt spraying. Other tests using a perforated steel plate substrate in place of the steel screen, while giving higher potentials when melt sprayed with the invention coatings, gave similar results.

EXAMPLE 7

A 2.31 inch diameter cathode test specimen of No. 6 mesh steel wire screen, which had been cleaned by grit-blasting, was coated on one side by multiple plasma sprays passes while concurrently air cooling the specimen until a coating of 5+ mils was obtained. The coating composition melt sprayed was a homogeneous admixture of 40% particulate cobalt (Metco XP-1102) and 60% particulate zirconia (Metco 201 B-NS). The uncoated side of the cathode test specimen was then covered with an asbestos fiber diaphragm modified with polytetrafluoroethylene fibers, and the resulting asbestos diaphragm-covered cathode placed in a laboratory diaphragm cell that was used to electrolyze aqueous sodium chloride under the following average conditions: current density of 1 ASI, catholyte temperature of 65–75° C, anolyte brine concentration of 310 gpl (acidified with HCl to a pH of about 2), and catholyte caustic concentration of 130–140 gpl. As compared to an equivalent diaphragm cell similarly operated and equipped with a No. 6 mesh steel screen cathode that been sandblasted only and gave potentials of 1.29 ± 0.01 volts during the test period, the invention coated cathode reduced hydrogen overvoltage initially 0.08 volts, and after running virtually continuously for 9 months, still lowered the hydrogen overvoltage 0.07 volts with no apparent signs of incipient failure. Cathode potentials were determined against a saturated calomel electrode.

TABLE

| Example | Cathode[1] Coating | Melt Spraying[2] Method Used | Cathode[3] Potential | Hydrogen Overvoltage Decrease (Volts) |
|---|---|---|---|---|
| Control | None | — | 1.21 | — |
| | | | 1.25 | — |
| | | | 1.28 | — |
| | | | 1.31 | — |
| 1 | Cobalt - 40% | Flame | 1.12 | .09 |
| | Zirconia - 60% | | 1.18 | .07 |
| | | | 1.21 | .07 |
| | | | 1.24 | .07 |
| 2 | Cobalt - 40% | Plasma | 1.12 | .09 |
| | Zirconia - 60% | | 1.17 | .08 |
| | | | 1.20 | .08 |
| | | | 1.23 | .08 |
| 3 | Cobalt - 40% | Plasma | 1.15 | .06 |
| | Zirconia - 60% | | 1.20 | .05 |
| | | | 1.24 | .04 |
| | | | 1.26 | .05 |
| 4 | Cobalt - 40% | Plasma | 1.14 | .07 |
| | Zirconia - 60% | | 1.19 | .06 |
| | | | 1.22 | .06 |
| | | | 1.24 | .07 |
| 5 | Cobalt - 70% | Plasma | 1.13 | .08 |
| | Zirconia - 30% | | 1.19 | .06 |
| | | | 1.23 | .05 |
| | | | 1.26 | .05 |
| 6 | Cobalt - 70% | Plasma | 1.11 | .10 |
| | Zirconia - 30% | | 1.15 | .10 |
| | | | 1.20 | .08 |

TABLE-continued

| Example | Cathode[1] Coating | Melt Spraying[2] Method Used | Cathode[3] Potential | Hydrogen Overvoltage Decrease (Volts) |
|---|---|---|---|---|
| | | | 1.22 | .09 |

Footnotes:
[1]The coating used in Examples 1 and 2 was Meteo XP-1119, a homogeneous admixture of 40% particulate cobalt and 60% particulate zirconia. The coating used in Examples 3–6 was a homogeneous admixture of Meteo XP-1102 particulate cobalt metal and Meteo 201 B-NS particulate zirconia. The Meteo powders were obtained from Meteo Inc. of Westbury, L.I., N.Y.
[2]In Examples 2, 4 and 6 the steel mesh specimens were cooled by impinging streams of air that surrounded the spray pattern. In Example 1, the specimen was air cooled a few minutes between spray passes.
[3]Volts at 1, 2, 3 and 4 amperes current density per square inch of immersed cathode.

What is claimed is:

1. A cathode for the electrolysis of water or an aqueous alkali metal halide solution which comprises an electrically conductive substrate bearing on at least part of its surface a coating of a melt-sprayed admixture consisting essentially of particulate cobalt and particulate zirconia.

2. The cathode of claim 1 in which the admixture contains 40–90% by weight cobalt and 60–10% by weight zirconia based on the combined weight of cobalt and zirconia in the admixture.

3. The cathode of claim 1 in which the admixture contains 40–70% by weight cobalt and 60–30% by weight zirconia based on the combined weight of cobalt and zirconia in the admixture.

4. The cathode of claim 1 in which the substrate is steel.

5. The cathode of claim 4 in which the admixture contains 40–90% by weight cobalt and 60–10% by weight zirconia based on the combined weight of cobalt and zirconia in the admixture.

6. The cathode of claim 4 in which the admixture contains 40–70% by weight cobalt and 60–30% by weight zirconia based on the combined weight of cobalt and zirconia in the admixture.

7. In a halo-alkali electrolysis cell having a separator the improvement which comprises the cathode of claim 2.

8. In a water electrolyzer, the improvement which comprises the cathode of claim 2.

9. A method for producing a cathode for the electrolysis of water or an aqueous metal halide solution which comprises melt spraying upon the surface of an electrically conductive substrate, an admixture consisting essentially of about 40–90% by weight of particulate cobalt and about 60–10% by weight of particulate zirconia.

* * * * *